United States Patent [19]

Vosika

[11] Patent Number: 4,479,524

[45] **Date of Patent: * Oct. 30, 1984**

[54] LOG SPLITTING BLASTING WEDGE AND ANCHOR SYSTEM IMPROVEMENTS

[76] Inventor: Albert F. Vosika, Rte. 2, Crete, Nebr. 68333

[ * ] Notice: The portion of the term of this patent subsequent to Sep. 28, 1999 has been disclaimed.

[21] Appl. No.: 425,179

[22] Filed: Sep. 28, 1982

Related U.S. Application Data

[63] Continuation-in-part of Ser. No. 307,782, Oct. 2, 1981, Pat. No. 4,351,376.

[51] Int. Cl.[3] ..... B27L 7/00

[52] U.S. Cl. ..... 144/366; 89/1 B; 144/193 G; 144/2 N

[58] Field of Search ..... 144/193 R, 193 G, 2 N; 89/1 B; 248/125, 669

[56] References Cited

U.S. PATENT DOCUMENTS

| | | | |
|---|---|---|---|
| 1,533,579 | 4/1925 | Webber | 144/193 G |
| 1,742,573 | 1/1930 | Berg | 144/193 G |
| 1,795,573 | 3/1931 | Nowalk | 248/669 |
| 1,965,136 | 7/1934 | Crume | 89/1 B |
| 2,132,114 | 10/1938 | Hutchison | 144/193 G |
| 2,991,966 | 7/1961 | Varel | 248/669 |
| 3,464,655 | 9/1969 | Schuman | 248/669 |

FOREIGN PATENT DOCUMENTS 6727 3/1932 Australia .

*Primary Examiner*—W. D. Bray

*Attorney, Agent, or Firm*—Zarley, McKee, Thomte, Voorhees & Sease

[57] ABSTRACT

A log splitting method and apparatus includes placing a charge of blasting powder in a log splitting blasting wedge, axially driving the wedge into one end of a log to be split, adjusting the height of a wedge receiving sleeve on the tower of an anchor structure and moving the anchor structure up against the wedge, igniting the charge in the wedge, thereby blasting the log into several sections. The anchor structure may be secured in place by ground stakes. For making firewood, logs can thus be split first, then blocked. The wedge may alternately be set in the side of a tree stump with the anchor structure supported in a cavity excavated on one side thereof to split the stump for facilitating its removal.

21 Claims, 14 Drawing Figures

LOG SPLITTING BLASTING WEDGE AND ANCHOR SYSTEM IMPROVEMENTS

CROSS REFERENCE TO RELATED APPLICATION

This application is a continuation-in-part of Ser. No. 307,782, filed on Oct. 2, 1981, now U.S. Pat. No. 4,351,376.

BACKGROUND OF THE INVENTION

The present invention is directed generally to certain improvements in the log splitting blasting wedge and anchor system of the inventor's above-referenced prior patent application. More specifically, the present invention is directed to a log splitting method and apparatus wherein the wedge may be more easily set into the end of a log and wherein the anchor structure may be securely positioned without moving the log. The invention is further directed to a method of making firewood wherein logs are first split, then blocked. Finally, the invention includes an application of the blasting wedge for removing tree stumps.

The log splitting blasting wedge and anchor system of the inventor's prior patent application presented a significant advance in the art by enabling logs to be split in substantially less time and with less effort than is required for operating commonly used hydraulic log splitters. Whereas the handling and movement of the logs to be split was thereby substantially reduced, it remained necessary to roll the log onto the forwardly extended tines of the prior anchor structure. Furthermore, a rather substantial force was required for driving the wedge and anchor structure together toward the end of the log for setting the wedge.

Accordingly, a primary object of the invention is to provide an improved method and apparatus for splitting logs with a blasting wedge.

Another object is to provide a method and apparatus for splitting logs with a blasting wedge and anchor structure which eliminates any need for moving the log to be split.

Another object is to provide an improved method and apparatus for securing the anchor structure to further resist the recoil forces of the blasts of the wedge.

Another object is to provide a method of preparing firewood which eliminates the handling and blocking of large unsplit logs.

Another object is to provide a method for facilitating the removal of tree stumps using the blasting wedge and anchor structure of the invention.

Finally, an object is to provide an improved log splitting blasting wedge and anchor structure which are simple and rugged in construction, economical to manufacture and safe and efficient in operation.

SUMMARY OF THE INVENTION

A method of splitting logs according to the present invention includes placing a charge of blasting powder in a log splitting blasting wedge, axially driving the wedge into one end of a log to be split, adjusting the height of the wedge receiving sleeve of the anchor structure, moving the anchor structure into position against the wedge and igniting the charge in the wedge. The blast of the charge instantly splits the logs into several sections. No prior movement of the unsplit log is required whatsoever. This method is therefore particularly helpful with the splitting of very large logs. Since the wedge is set into a log prior to receipt in the support sleeve of the anchor structure, the step of setting the wedge in any size log has been simplified and greatly facilitated.

The anchor structure is adapted to be secured in place independently of any direct contact between the anchor structure and log. Recoil forces are preferably resisted by staking the anchor structure to the ground. The anchor structure is therefore designed so that it may be secured with one or several ground stakes to thereby accommodate varying staking requirements depending upon the firmness of the soil, size of the log and size of the charge being used in the wedge. Alternatively, a transverse hold down bar on the anchor structure may have logs placed on its opposite ends.

A cup-shaped cap is fit onto the end of the wedge to prevent damage to the wedge as it is driven into the logs.

Since the wedge may not be driven in at a perfectly horizontal inclination, the wedge receiving sleeve of the anchor structure is over-sized to accommodate limited misalignment.

In the making of firewood, the invention contemplates the splitting of large logs into manageable sections prior to blocking of the logs to the desired length of the firewood.

The blasting wedge and anchor structure of the invention finds further application in the removal of tree stumps. One method is to first split the stump into sections. Thus the individual sections can be removed from the ground with less force and with less expensive equipment than would be required for removal of the entire stump as a unit. Another method is to use the blasting force to separate the stump from many of its roots for easier removal of the stump as a unit.

DESCRIPTION OF THE PREFERRED EMBODIMENTS

Figure 1:
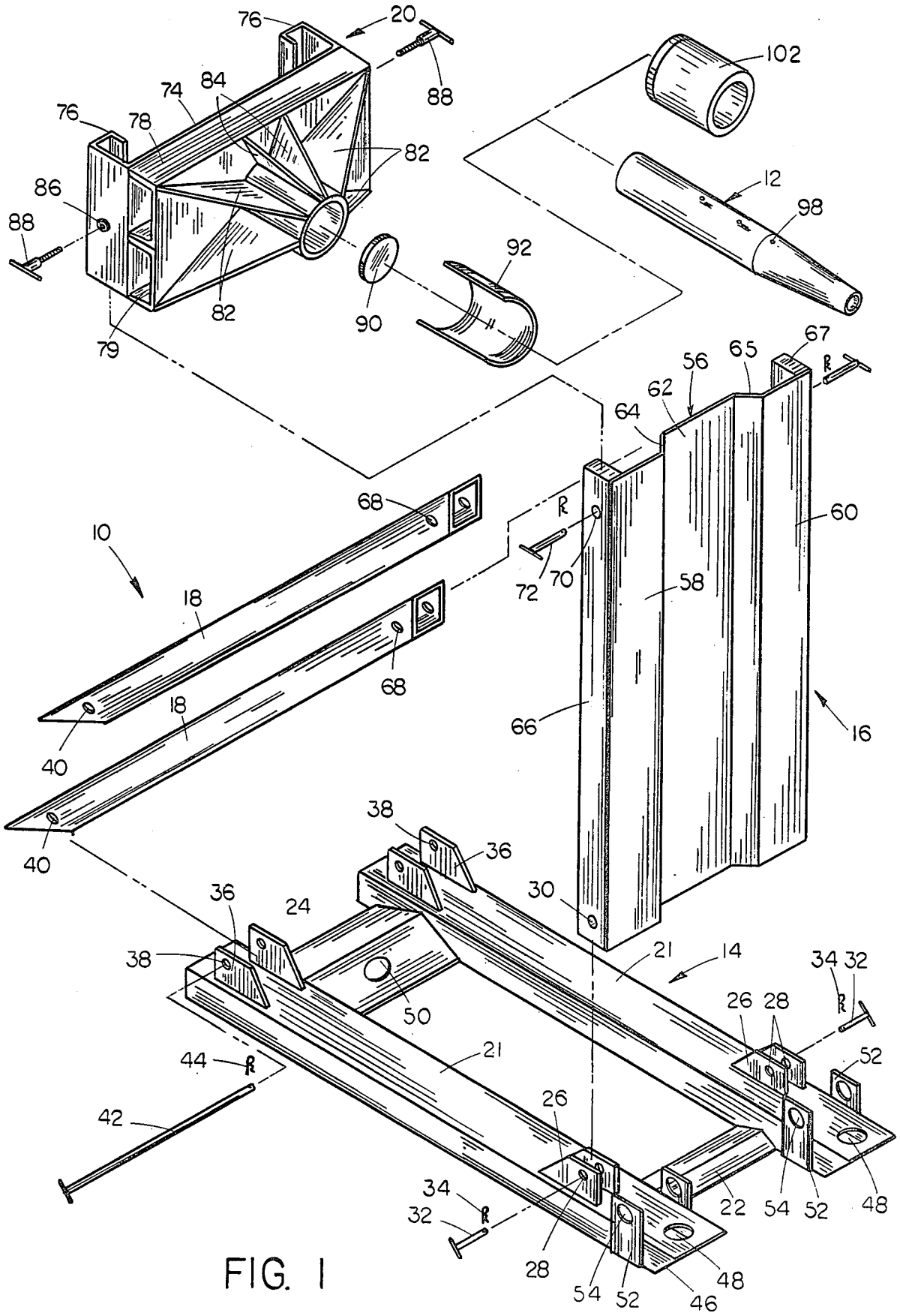
FIG. 1 is an exploded perspective view of the blasting wedge, setting cap and anchor structure of the invention.
Figure 2:
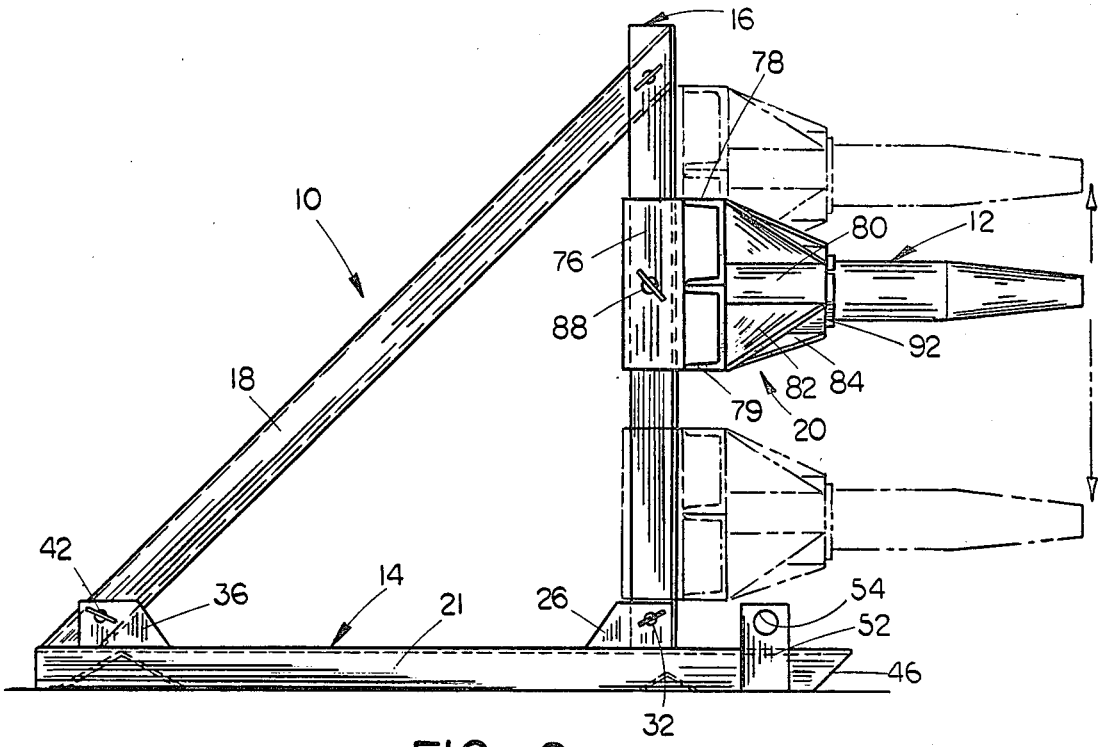
FIG. 2 is a side elevational view of the wedge and anchor structure.

The anchor structure 10 and blasting wedge 12 of the present invention are shown in FIGS. 1 and 2. The blasting wedge is adapted to be set into the end of a log, whereupon the anchor structure is moved into position to provide backing for the wedge to resist recoil forces when the log is split by the blast from the wedge.

The anchor structure 10 is simply constructed of a horizontal base frame 14 having an upright tower 16 supported adjacent the forward end thereof with downwardly and rearwardly inclined braces 18 securing the tower for slidably supporting a wedge receiving table structure 20 thereon.

The base frame 14, as shown in FIG. 1, includes a pair of elongated U-shaped channels 21 arranged in transversely spaced-apart parallel relation and secured together by front and rear cross members 22 and 24. The cross members have a shallow V-shape cross section for added strength. Each channel 21 includes a tower support bracket consisting of a pair of upright ears 26 at positions spaced rearwardly from the forward ends of the channels. These ears have holes 28 adapted for registration with holes 30 at the base of the tower for receiving lock pins 32 which are provided with retention clips 34. Likewise, each channel 21 has a brace bracket at the rearward end thereof consisting of a pair of upright ears 36 having holes 38 for registration with holes 40 in the lower ends of the braces whereby an elongated lock pin 42 may be inserted through the brackets of both channels and retained in position by clip 44.

At the forward end of each channel 21, the side flanges are inclined upwardly and forwardly as at 46 to facilitate forward sliding movement of the base frame. Also, a hole 48 is provided in the top of each channel adjacent the forward end for receiving a ground stake. An auxiliary ground stake hole 50 is located in the rear cross member 24. As a backup securement system, the base frame is provided with upstanding brackets 52 adjacent the forward end thereof, with all of the brackets having aligned holes 54 for receiving a transversely extended hold down bar which is further described hereinbelow. Note that the brackets 52 are spaced rearwardly of stake holes 48 to avoid interference.

The tower structure 16, also shown in FIG. 1, includes a transversely extended and forwardly facing plate 56 including transversely spaced-apart co-planar side portions 58 and 60 and a center portion 62 which is recessed rearwardly of the side portions by integral bend portions 64 and 65. Reinforcement posts 66 and 67 are securely welded to the tower plate 56 behind the side edges thereof.

The braces 18 are shown as square section tubing with tapered ends for presenting flush engagement surfaces with both the tower plate 56 and base frame channels 21. The upper ends of the braces have holes 68 which are registrable with upper holes 70 in the posts 66 and 67 for receiving lock pin 72.

Figure 7:
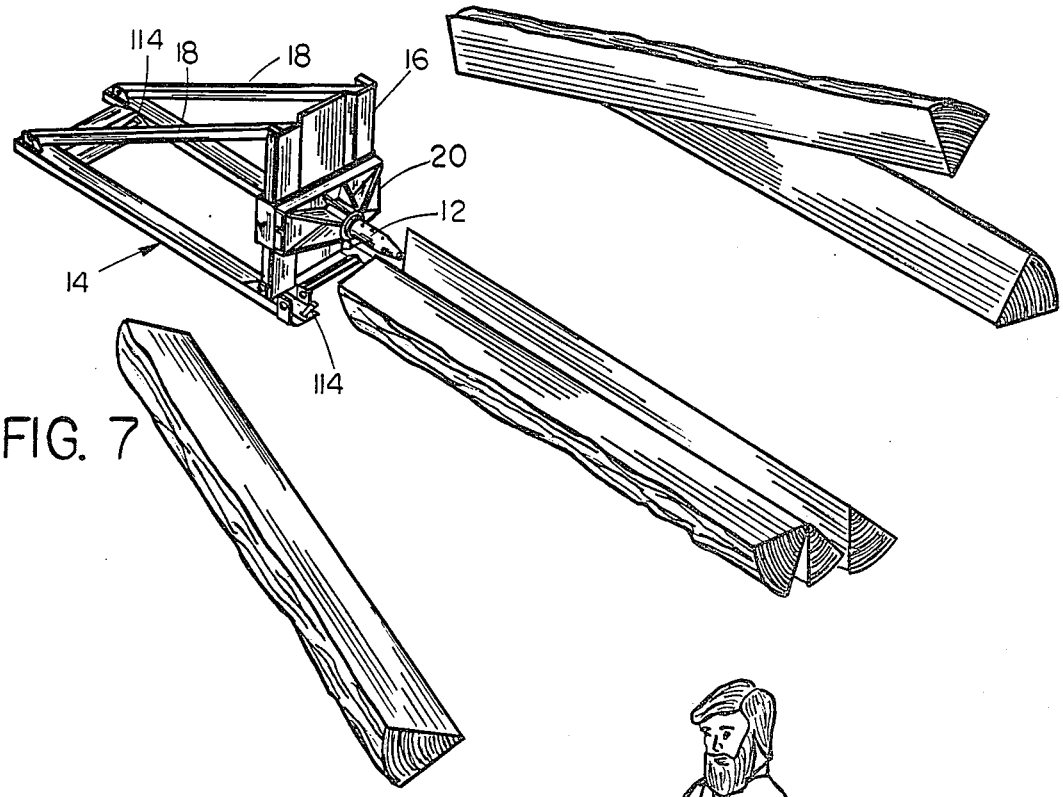
FIG. 7 is a diagrammatic perspective view of a log being split.

The wedge receiving table structure 20 is also shown in FIG. 1 as including a forwardly facing slide plate 74 having a pair of rearwardly extended generally J-shaped slide brackets 76 for retaining the table structure in slide-fit relation on the tower 16 as shown in FIGS. 2 and 7. The slide plate 74 slidably engages the tower side portions 58 and 60. A pair of U-shaped channels 78 and 79 extend transversely across the front face of slide plate 74 for reinforcement. A wedge support sleeve 80 is centered relative to the adjoining flanges of channels 78 and 79 and secured thereon by a plurality of gussets 82 and 84 which radiate outwardly from the sleeve 80. The slide plate 74, brackets 76, channels 78 and 79, sleeve 80 and gussets 82 and 84 are all welded together into a solid integral table structure. The slide brackets 76 are provided with threaded openings 86 for receiving manually adjustable lock screws 88 for retaining the table at any selected vertical position on the tower 16.

Figure 3:
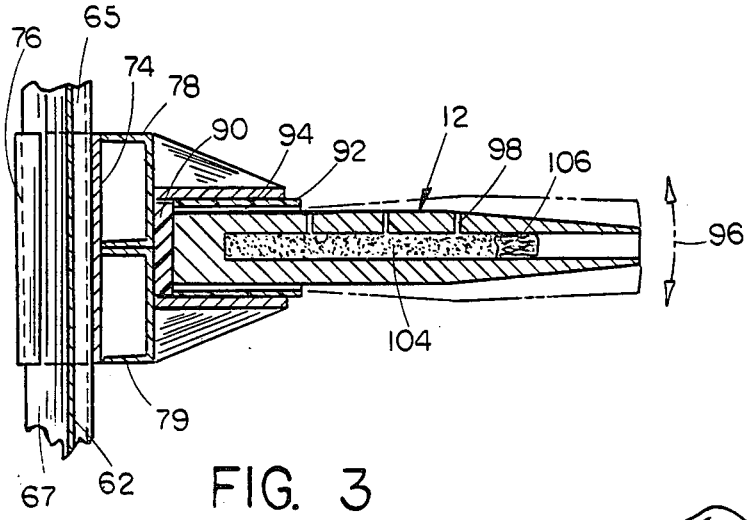
FIG. 3 is an enlarged sectional side view of the wedge and vertically adjustable wedge support table.

The sleeve 80 is shown in FIGS. 1 and 3 as containing a disk shape nylon cushion 90 and a sleeve liner 92 of nylon or the like for protecting the sleeve from direct contact with the wedge 12. It can be seen in FIG. 3 that the internal diameter of sleeve 80 is such that even with the sleeve liner 92 in place, a clearance space 94 is provided between the wedge and liner to accommodate limited misalignment between the wedge 12 and sleeve 80 as indicated by arrow 96.

The blasting wedge 12 is similar to the wedge of applicant's prior patent application Ser. No. 307,782 except that the mounds surrounding the wick holes have been deleted and third wick hole 98 has been added to accommodate larger charges. Note that the third wick hole 98 may open through the forward tapered end portion 100 of the wedge 12. Applicant has successfully used a large 2 ½ inch diameter and 18 inch long wedge having a 16 inch long, one inch diameter bore with three 7/32nds inch diameter wick holes positioned as shown in the drawings. The large wedge is designed to split logs up to six feet in diameter. A smaller wedge may be provided having a12½ inch length and 2½ inch outside diameter with a one inch diameter and 11 inch long bore with three wick holes for splitting logs up to three feet in diameter.

Figure 4:
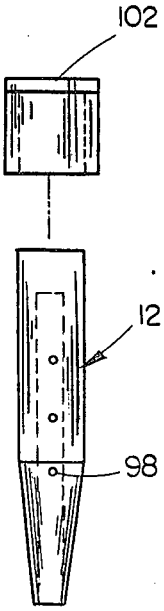
FIG. 4 is a top plan view of the blasting wedge and setting cap.

Fig. 4 illustrates a protective cap 102 which is cup-shaped and adapted to be fit onto the rearward end of the wedge to prevent flaring of the rearward end of the wedge from direct steel-to-steel contact with a sledge hammer.

Figure 5:
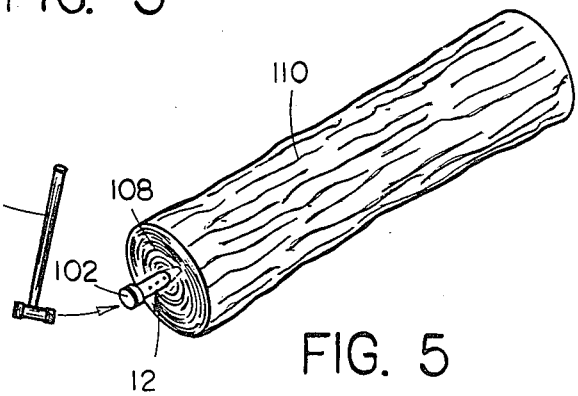
FIG. 5 is a diagrammatic perspective view of the wedge being set in the end of a log.
Figure 6:
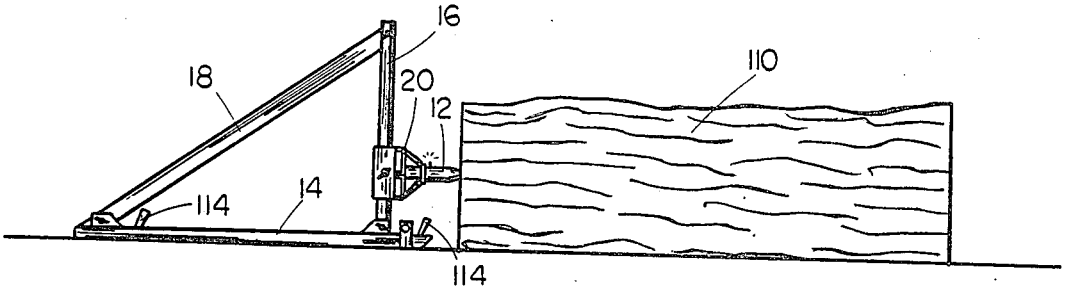
FIG. 6 is a diagrammatic side elevational view of the wedge and anchor structure as secured at the end of a log.

In operation, the wedge is loaded with a charge of black blasting powder 104 as shown in FIG. 3 and a wadding of paper towel or the like is inserted to retain the charge in the wedge. The protective cap 102 is then slipped onto the rearward end of the wedge 12. The forward tapered end of the wedge is then engaged against the center of the end 108 of a log 110. The wedge is preferably centered relative to the rings which are evident in the end of the log. The wedge is then set in place as indicated in FIG. 5 by driving the forward end into the log to a depth of approximately 2 to 4 inches. This is done by striking the protective cap 102 with a sledge hammer 112.

The next step is to adjust the height of the wedge receiving table structure 20 on tower 16 for alignment with the set wedge 12. The table is secured in position by the lock screws 88 whereupon the anchor structure 10 is then advanced toward the log with the wedge 12 being received within sleeve 80 and engaged against the cushion disk 90. The anchor structure is then secured in place by driving ground stakes 114 into the ground through the ground stake holes 48 and 50. Preferably the ground stakes are inclined upwardly and forwardly to better resist rearward recoil movements of the anchor structure. All that remains to be done is to insert a wick through the forwardmost wick hole which communicates with the powder, light the wick and walk to a safe distance behind the anchor structure to watch the blast which instantly splits the log into several sections as shown in FIG. 7.

For very large logs, one or more of the split sections may be so large that the blasting procedure can be repeated for that section to further reduce it into manageable size split sections.

Figure 8:
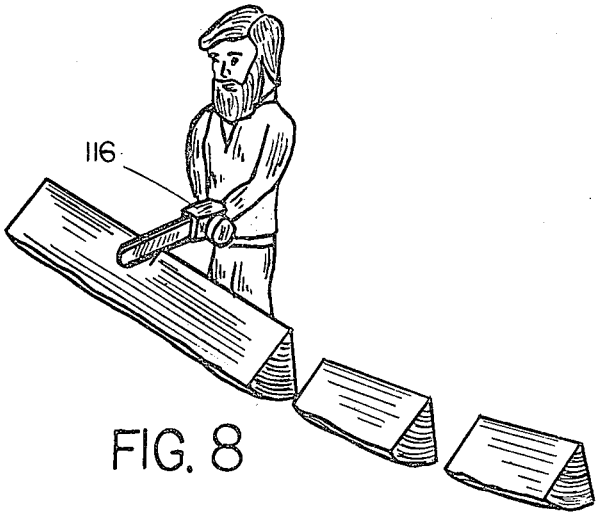
FIG. 8 is a diagrammatic perspective view of a split log section being blocked.

To produce firewood which is ready for loading and stacking, one need only block the split section to the desired length as indicated in FIG. 8. The split sections are all of a manageable size and blocking can be easily accomplished with a chain saw 116.

Figure 9:
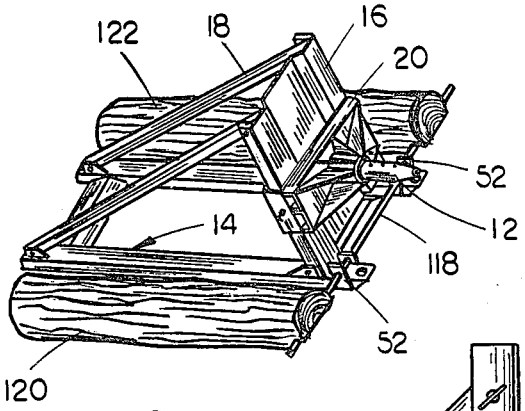
FIG. 9 is a diagrammatic perspective view of the anchor structure and hold down bar.
Figure 10:
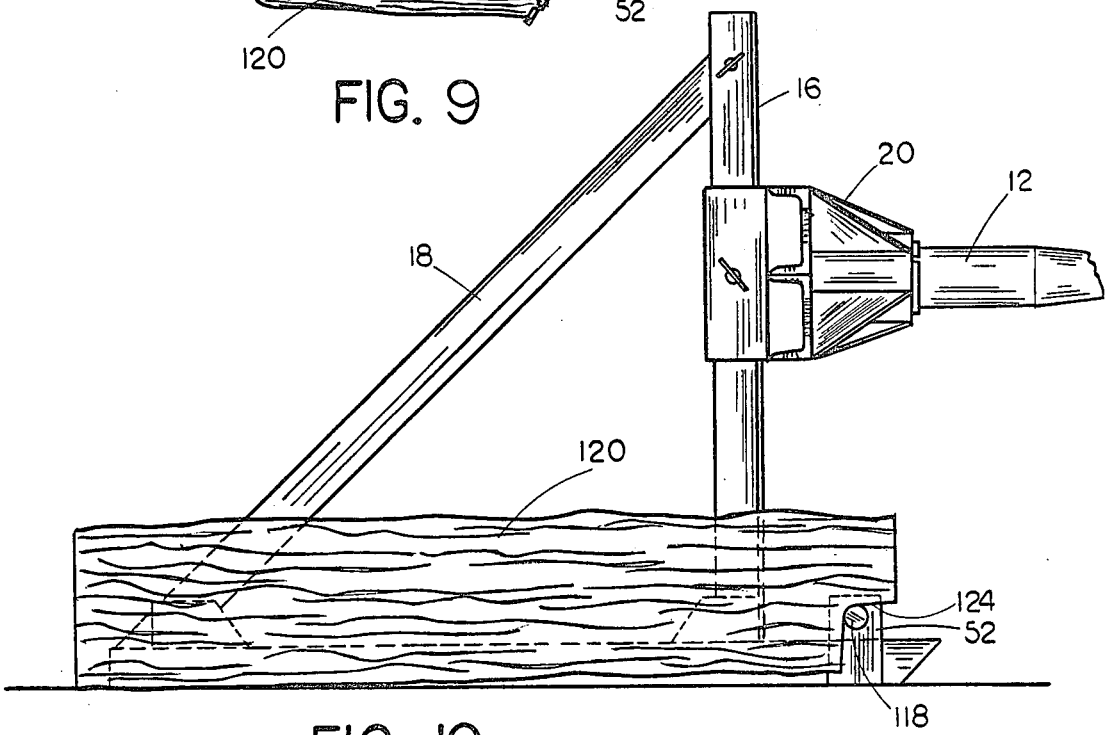
FIG. 10 is a side elevational view of the anchor structure hold down bar in operation.

If ground stakes cannot be used, such as on very rocky land, an alternate system for securing the anchor structure 10 may be used, as illustrated in FIGS. 9 and 10. An elongated hold down bar 118 is extended through the aligned holes 54 of hold down bar brackets 52 so that its opposite ends protrude transversely from both sides of the anchor structure. Second and third logs 120 and 122 can then be positioned with their ends resting on the ends of the hold down bar. It is preferred that the ends of the second and third logs 120 and 122 be notched as indicated in FIG. 10 at 124 and that the notched end be placed onto hold down bar 118 so as to effectively resist both vertical and rearward recoil forces resulting from the blast of a log.

Figure 11:
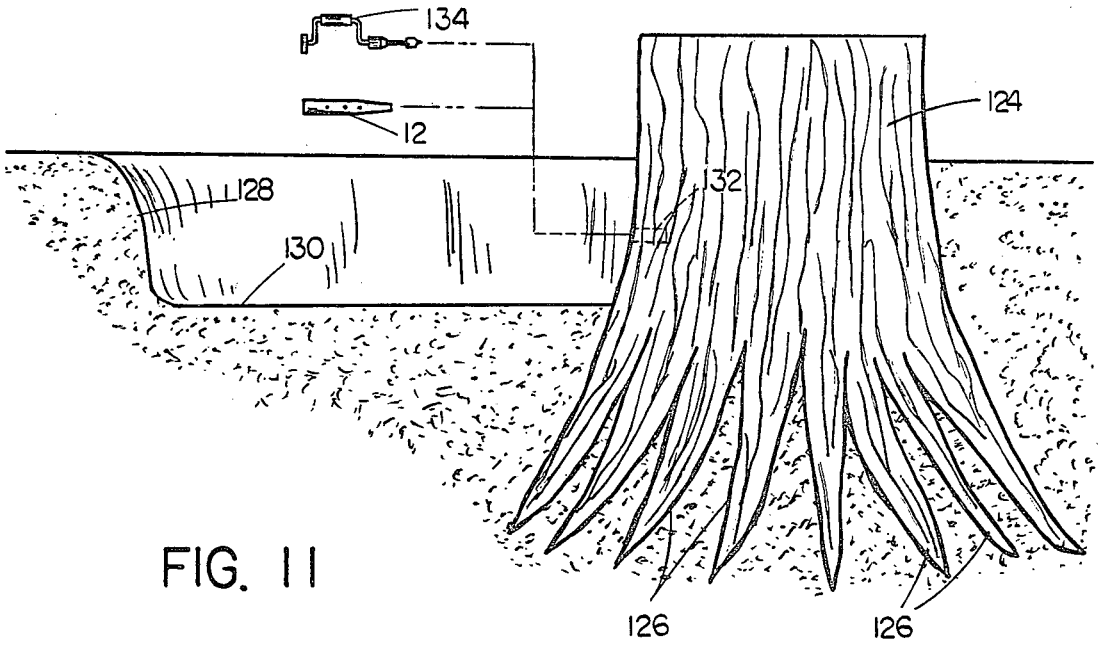
FIG. 11 is a partially sectional side view of a tree stump being prepared to receive the blasting wedge.
Figure 12:
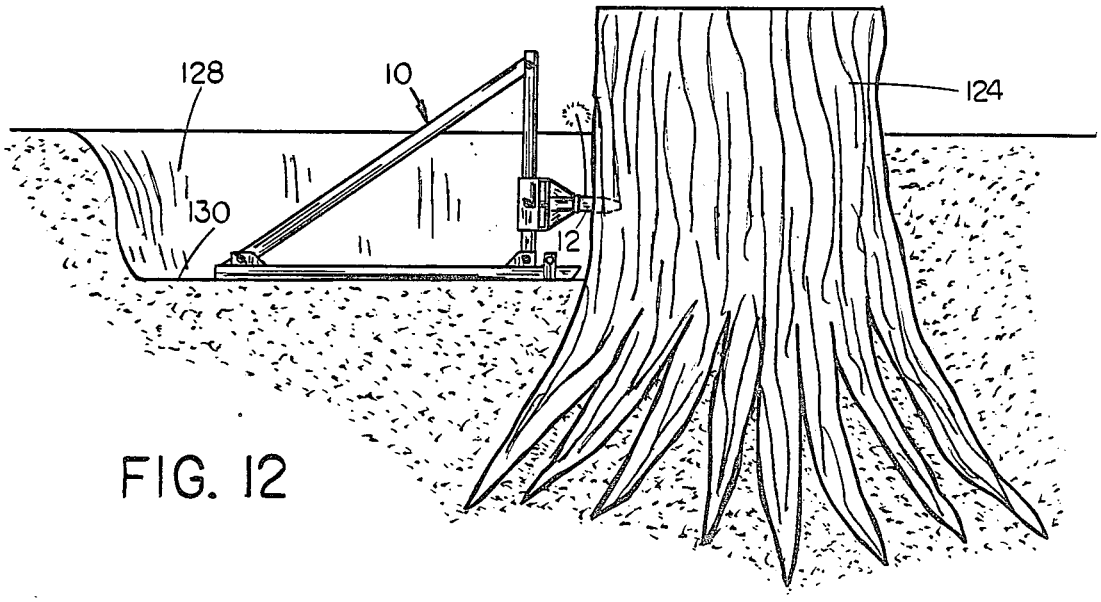
FIG. 12 is a partially sectional side view of a tree stump with the blasting wedge and anchor structure in operative position.
Figure 13:
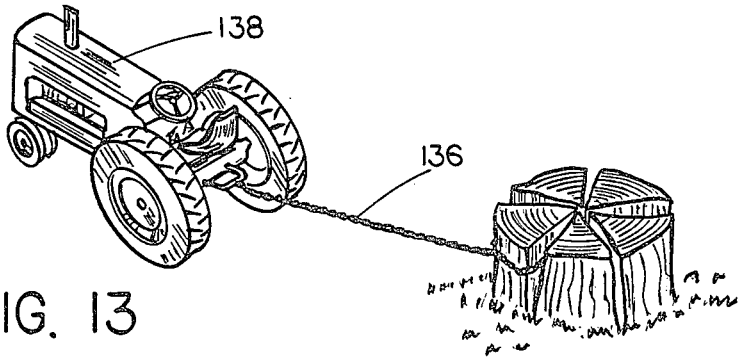
FIG. 13 is a diagrammatic perspective view of a split tree stump section being pulled from the ground.

Whereas the anchor structure 10 and blasting wedge 12 of the present invention are primarily intended for splitting logs, they are also very useful for facilitating the removal of tree stumps. Referring to FIGS. 11–13, there is shown a tree stump 124 including a plurality of roots 126. The ground is excavated at one side of the stump to expose the side of the stump for receiving the wedge. The excavated cavity 128 has a floor 130 for supporting the anchor structure. A hole 132 is bored into the side of the stump with a drill 134. A charge and wadding are placed in the wedge and the wedge is then inserted into hole 132. The anchor structure is lowered into the cavity 128; the table structure 20 is adjusted; and the anchor structure is advanced toward the stump for receiving the wedge 12 in sleeve 80. Ground stakes are hammered into place. All that remains to be done is to insert a wick into a selected wick hole, light it, and walk away to witness the blast which rips through the stump splitting in into sections similar to the sections formed when splitting a log. The individual sections can then be pulled from the ground with a chain 136 and tractor 138 far more easily than the entire stump could be removed as a unit. In fact, whereas the tractor 138 may be incapable of pulling an entire stump from the ground, a simple blast from the wedge and anchor structure of the present invention reduces the stump to manageable sections capable of removable by the tractor.

Figure 14:
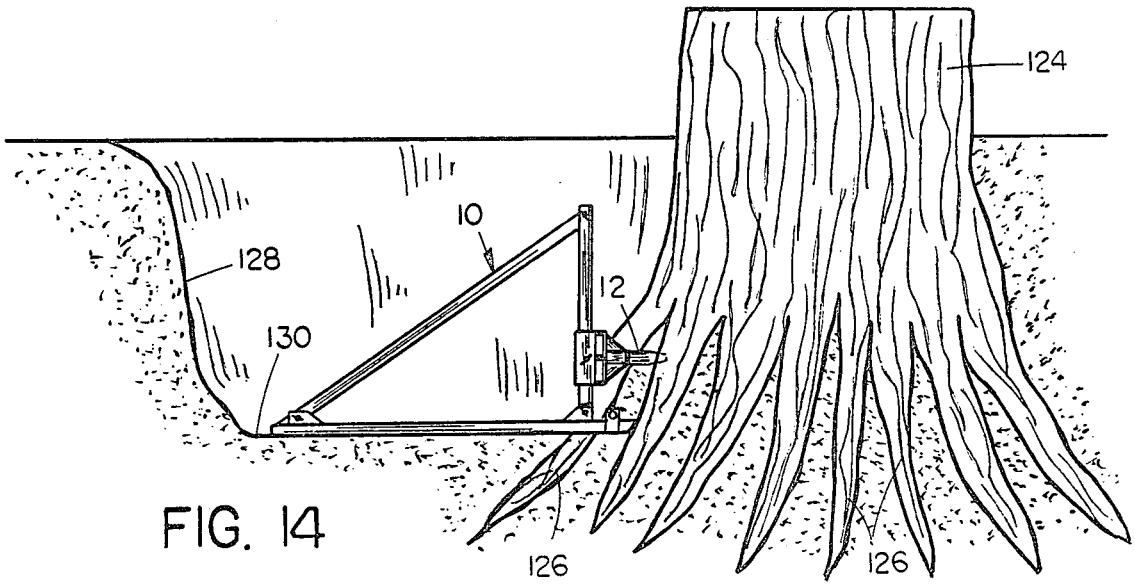
FIG.14 shows an alternate method of removing a tree stump.

An alternative method of removing a tree stump is illustrated in FIG. 14 wherein a somewhat deeper cavity 128 is excavated so that the wedge may be set at a position facing the roots. The wedge 10 may be set in the ground between adjacent roots or it may be actually set into a larger root. In either case, when the wedge is backed with the anchor structure and the charge is ignited, the concentrated energy thrust from the blast rips and tears the stump from many of its roots so that it can be far more easily dislodged and removed from the ground as a unit.

It is anticipated that the blasting wedge and anchor structure of the invention will also be useful for blasting work in rock quarries and for breaking slate.

The anchor structure of the present invention is designed so that even for splitting logs up to six feet in diameter, the overall structure need not weigh more than 100 pounds. As a result, even a large anchor structure is easily maneuvered by an individual. Thus the present invention enables a one-man logging operation capable of making more wood than several men could make in the same amount of time using conventional hydraulic log splitters. A principal advantage of the method and apparatus of the present invention is that is enables the operator to split logs before blocking them. Thus the operator need not worry about blocking large logs which are difficult to maneuver. Furthermore, the split section often include cracks from the blast so that the cracked portions readily separate when the section is blocked.

It can be seen from FIG. 1 that the anchor structure of the present invention can be quickly and easily disassembled by simply removing five pins and collapsing the unit for easy transport and storage.

Thus there has been shown and described an improved log splitting blasting wedge and anchor system which accomplishes at least all of the stated objects.

I claim:

1. A method of splitting logs, comprising, providing a blasting wedge and an anchor structure with a
height adjustable wedge receiving sleeve, placing a charge of blasting powder in the wedge, axially driving the wedge into one end of a log to be split
thereby setting the wedge in the log, adjusting the height of the wedge receiving sleeve for
approximate alignment with the set wedge, moving the anchor structure toward the end of the log so that
the wedge is received within the adjusted sleeve, and igniting the charge in the wedge.

2. The method of claim 1 further comprising staking the anchor structure to the ground to further resist recoil.

3. The method of claim 2 wherein said anchor structure is provided with at least one stake hole therein and said step of staking the anchor structure comprises inserting a stake into said stake hole and driving the inserted stake into the ground.

4. The method of claim 3 further comprising driving the stake into the ground so that the stake is inclined upwardly and forwardly relative to the ground.

5. The method of claim 1 wherein the step of driving the wedge into one end of a log comprises providing a generally cup-shaped cap, placing the forward end of the wedge against the end of a log, fitting said cap onto the rearward end of the wedge, and striking the cap in a direction toward the log.

6. The method of claim 1 further comprising blocking the log subsequent to splitting the log.

7. The method of claim 1 further comprising securing said anchor structure against recoil movement away from the log.

8. The method of claim 7 wherein said anchor structure includes bracket means for receiving a transversely extended hold down bar and said step of securing said anchor structure comprises resting second and third logs on the opposite ends of said hold down bar.

9. The method of claim 8 further comprising notching one end of said second and third logs for receiving said opposite ends of the hold down bar in said notched ends.

10. An apparatus for backing a generally cylindrical blasting wedge adapted to be axially set into one end of a log to be split, comprising, an elongated base frame having forward and rearward ends, an elongated tower structure having upper and lower ends, forward connector means for securing the lower end of said tower structure to said base frame adjacent the forward end thereof, elongated brace means having upper and lower ends, means for connecting the upper end of said brace means to said tower structure adjacent the upper end thereof, rearward connector means for connecting the lower end of said brace means to said base frame adjacent the rearward end thereof, said brace means being of a length such that upon connection of said brace means to said tower structure and base frame, said tower structure is secured in upright relation on said base frame, a blasting wedge support table extended transversely across said tower and vertically adjustably mounted thereon, said table including an open forward ended wedge support sleeve secured thereon for receiving and supporting a blasting wedge in forwrdly extended generally horizontal relation, means for releasably securing the table at selected vertical positions on said tower structure whereby said wedge support sleeve may be supported in substantially aligned relation with a wedge set in the end of a log to be split, and securement means for securing said base frame against recoil movement away from a log to be split, said securement means being operative independently of contact between said apparatus and a log to be split.

11. The apparatus of claim 10 wherein the inside diameter of said sleeve exceeds the outside diameter of said wedge whereby a clearance space is provided therebetween to accommodate limited misalignment of said wedge and sleeve.

12. The apparatus of claim 11 wherein said securement means comprises means for staking said base frame to the ground.

13. The apparatus of claim 12 wherein said means for staking said base frame comprises a plurality of stake holes in said base frame through which stakes may be driven into the ground.

14. The apparatus of claim 13 wherein said base frame comprises a pair of elongated open bottomed channel members and at least one cross member securing said channel members in parallel spaced-apart relation, at least one stake hole being provided in each channel member.

15. The apparatus of claim 14 wherein a stake hole in each channel member is positioned forwardly of said forward connector means.

16. The apparatus of claim 14 wherein said cross member has an auxiliary stake hole generally transversely centered thereon.

17. The apparatus of claim 10 wherein said securement means comprises an elongated hold down bar and bracket means on said base frame for supporting said bar in transversely extended relation across the base frame whereby second and third logs may be placed onto the opposite ends of said hold down bar.

18. The apparatus of claim 10 wherein said tower structure comprises an upright transverse plate including co-planar upright side portions and a vertically extended center portion which is recessed rearwardly of said side portions.

19. The apparatus of claim 18 wherein said table comprises a transverse slide plate for sliding engagement on said side portions, rearwardly extended slide brackets on opposite ends of said slide plate for retaining said slide plate in slide-fit relation on said tower structure, said wedge support sleeve extending forwardly from said slide plate and being generally centered thereon, and a plurality of gussets radiating outwardly from said sleeve for securing it relative to said slide plate.

20. The apparatus of claim 19 further comprising a pair of channels interposed between said sleeve and slide plate with said sleeve centered relative to adjacent flanges of said channels.

21. A method of making firewood, comprising providing a log to be split, a log blasting wedge and an anchor structure with a height adjustable wedge receiving sleeve, placing a charge of blasting powder into one end of the wedge, driving that one end of the wedge into one end of a log, causing the opposite end of the wedge to be received in the sleeve of the anchor structure, igniting the charge in the wedge thereby splitting the log into a plurality of split log sections, and blocking the split log sections.

* * * * *